US007296314B2

(12) United States Patent
Wyatt et al.

(10) Patent No.: US 7,296,314 B2
(45) Date of Patent: Nov. 20, 2007

(54) PATIENT SUPPORT SURFACE

(75) Inventors: Charles C. Wyatt, Corona, CA (US); David Buchicchio, Arcadia, CA (US)

(73) Assignee: Encompass Group, LLC, McDonough, GA (US)

( * ) Notice: Subject to any disclaimer, the term of this patent is extended or adjusted under 35 U.S.C. 154(b) by 0 days.

(21) Appl. No.: 11/325,656

(22) Filed: Jan. 4, 2006

(65) Prior Publication Data

US 2007/0151033 A1 Jul. 5, 2007

(51) Int. Cl.
*A47C 27/10* (2006.01)
*A47C 27/08* (2006.01)

(52) U.S. Cl. ..... 5/713; 5/710; 5/706

(58) Field of Classification Search ..... 5/713, 5/710, 706, 655.3, 654, 644, 680, 678, 400
See application file for complete search history.

(56) References Cited

U.S. PATENT DOCUMENTS

| | | | | | |
|---|---|---|---|---|---|
| 2,874,826 | A * | 2/1959 | Matthews et al. | ..... | 206/522 |
| 3,653,083 | A * | 4/1972 | Lapidus | ..... | 5/713 |
| 4,347,633 | A * | 9/1982 | Gammons et al. | ..... | 5/713 |
| 4,485,505 | A * | 12/1984 | Paul | ..... | 5/714 |
| 4,686,722 | A * | 8/1987 | Swart | ..... | 5/713 |
| 4,803,744 | A * | 2/1989 | Peck et al. | ..... | 5/713 |
| 4,947,500 | A * | 8/1990 | Seiler | ..... | 5/713 |
| 5,070,560 | A | 12/1991 | Wilkinson | | |
| 5,412,821 | A | 5/1995 | Wilkinson | | |
| 5,487,196 | A * | 1/1996 | Wilkinson et al. | ..... | 5/715 |
| 5,687,438 | A | 11/1997 | Biggie et al. | | |
| 5,692,256 | A | 12/1997 | Kramer et al. | | |
| 5,699,570 | A * | 12/1997 | Wilkinson et al. | ..... | 5/713 |
| 5,926,884 | A | 7/1999 | Biggie et al. | | |
| 6,223,369 | B1 | 5/2001 | Maier et al. | | |
| 6,269,505 | B1 * | 8/2001 | Wilkinson | ..... | 5/713 |
| 6,370,716 | B1 * | 4/2002 | Wilkinson | ..... | 5/715 |
| 6,782,574 | B2 | 8/2004 | Totton et al. | | |
| 6,826,795 | B2 * | 12/2004 | Wilkinson | ..... | 5/713 |
| 6,848,138 | B1 * | 2/2005 | Maier et al. | ..... | 5/730 |
| 2007/0151033 | A1 * | 7/2007 | Wyatt et al. | ..... | 5/713 |

FOREIGN PATENT DOCUMENTS

JP 405285029 A * 11/1993

OTHER PUBLICATIONS

Hill-Rom; VersaCare Bed System Surfaces; 4 pages.

* cited by examiner

*Primary Examiner*—Robert G. Santos
(74) *Attorney, Agent, or Firm*—Baker Donelson

(57) ABSTRACT

A support surface (10) is disclosed which includes a foam perimeter (18), a truncated-triangular shaped core (19), a foam topper (21), and a coverlet (22). The foam perimeter includes an interior well (25) defined by a floor (26), a top surface (27), and at least two diverging side walls (28). The core is comprised of a plurality of trapezoidal-shaped, inflatable air cells (31). Each air cell has a bottom wall (32), a top wall (33), two side walls (34), and two end walls (35). The ends walls diverge from each other as they extend from the bottom wall to the top wall so that each air cell has a generally trapezoidal shape along its lateral length.

5 Claims, 2 Drawing Sheets

PATIENT SUPPORT SURFACE

TECHNICAL FIELD

This invention relates generally to patient support surfaces.

BACKGROUND OF THE INVENTION

Healthcare costs and patient well being are effected by the degree of pressure relief for patients confined to beds for significant periods of time. Pressure sores, such as decubitus ulcers, potentially lead to infections and other conditions or complications. These can occur from prolonged pressure exposure, such as experienced by those confined to beds, whether in a hospital, nursing home, or private residence. Considerable efforts have been made to provide mattress systems or patient support surfaces which effectively redistribute and equalize pressure forces at the interactions between the patient and the support surface. Generally speaking, the more sophisticated techniques for achieving such pressure reductions are more involved to manufacture and are therefore more expensive. Several manufacturers today manufacture support surfaces which include several elongated air tubes, cells or cylinders combined with foam pieces or perimeter which surround the air tubes. Examples of embodiments having multiple, elongated air tubes are set forth in U.S. Pat. Nos. 5,692,256; 5,412,821, and 5,070,560.

The bed shown in U.S. Pat. No. 5,692,256 includes a stepped deck which includes an upper deck, and a lower deck coupled to the upper deck by a vertical deck side wall. Recently, manufacturers have angled the side wall SW of a stepped deck SD, as shown in FIG. 4. The space between the outermost air cell AC and the side wall SW is occupied with a resilient foam bolster B. These bolsters however limit the amount of area occupied by the air cells AC.

In view of the foregoing deficiencies associated with support surfaces and the beds associated therewith, there remains a need for a support surface which increases the usable surface area. It thus is to the provision of such that the present invention is primarily directed.

SUMMARY OF THE INVENTION

A patient support surface comprises a plurality of patient support air cells, each air cell being oriented laterally and having a generally trapezoidal shape along its lateral length, a resilient foam perimeter surrounding the air cells, and a foam topper overlaying the air cells.

DETAILED DESCRIPTION

Figure 1:
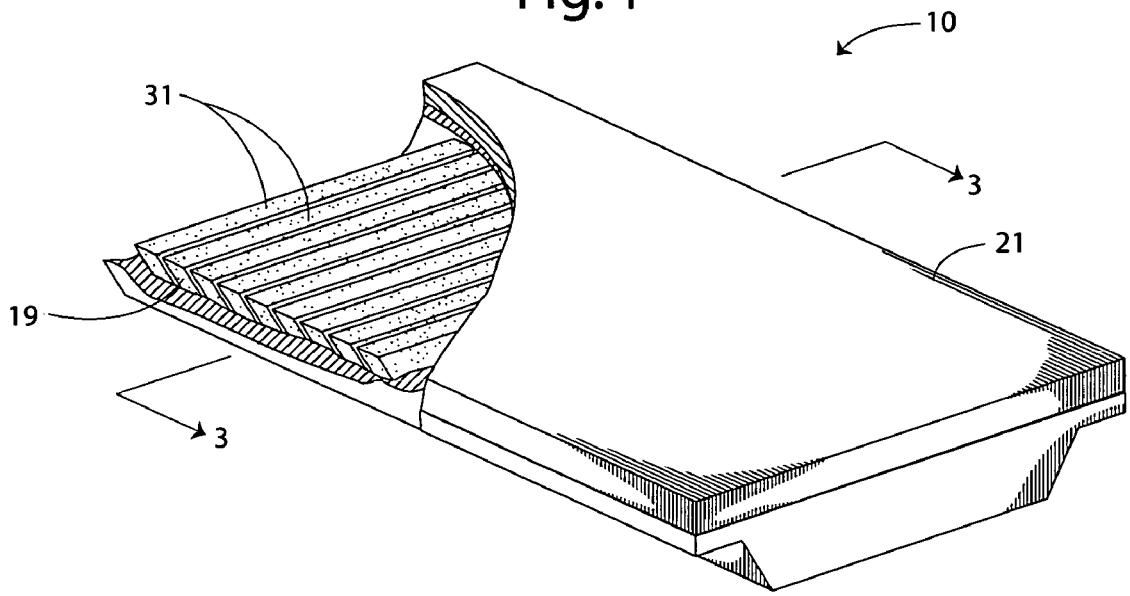
FIG. 1 is a perspective view, shown in partial cross-section, of a support surface embodying principles of the invention in a preferred form.
Figure 3:
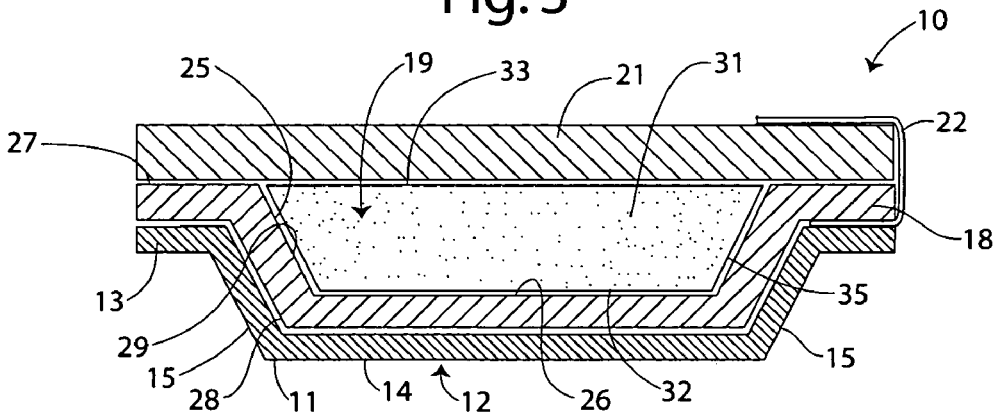
FIG. 3 is a cross-sectional view of the support surface of FIG. 2.

Referring next to the drawings, there is shown a patient support surface 10 in a preferred form of the invention. The support surface 10 is adapted to be coupled with a bed 11 similar to that shown in U.S. Pat. No. 5,692,256, which is specifically incorporated herein by reference. The bed 10 shown in the drawings includes a step deck 12 having an upper deck 13, a lower deck 14, and deck side walls 15. The deck side walls 15 are oriented at an inclined angle as they extend upwardly from the lower deck 14 to the upper deck 13.

The support surface 10 has a foam perimeter 18, a generally truncated-triangular shaped core 19, a foam topper 21, and a coverlet 22. The foam perimeter 18 includes an interior well 25 defined by a floor 26, a top surface 27, and at least two side walls 28 having interior facing surfaces 29 diverging from each other as they extend upwardly from the floor 26 to the top surface 27. The foam perimeter 18 may be made of any conventionally known mattress bolster material, such as resilient polyurethane.

The core 19 is comprised of a plurality of generally trapezoidal-shaped, inflatable air cells 31. Each air cell 31 has a bottom wall 32, a top wall 33, two oppositely disposed side walls 34 extending between the bottom wall 32 and the top wall 33, and two oppositely disposed end walls 35 extending between bottom wall 32 and the top wall 22. The ends walls 35 diverge from each other as they extend from the bottom wall 32 to the top wall 33 so that the air cell has a generally trapezoidal shape along its lateral length. The air cells 31 may be made of a woven nylon fabric fused to a heavy gauge polymeric film. The apparatus or assembly used to inflate the air cells 31 may be any conventionally known device used for such purposes, as for example that shown in U.S. Pat. No. 6,223,369, which is specifically incorporated herein by reference. The air cell material may be designed to be air impervious or air pervious (low air loss), depending upon the desired criteria or parameters of the support surface. The type of material utilized for the air cell may help determine the type of air inflation system associated therewith.

The foam topper 21 is configured to overlay the core 19 and top surface 27 of the perimeter 18. The topper 21 may be made of any conventionally known mattress topper material, such as resilient polyurethane, or multiple layers of different materials.

The coverlet 22 is configured to overlay the topper 21 and the top portion of the perimeter 18. The coverlet 22 may be made of any conventionally known coverlet material, such as a polyurethane coated polyester, polyurethane coated nylon, or a combination of one or more layers of these materials.

Figure 4:
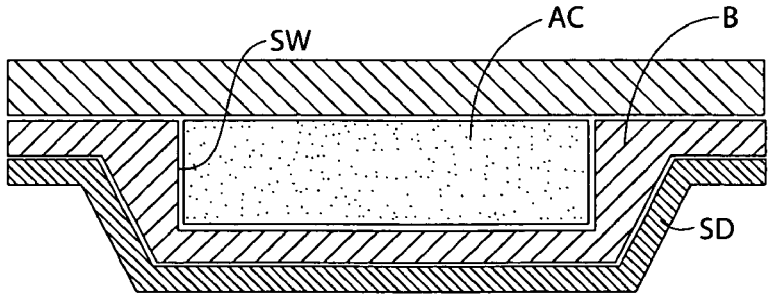
Fig. 4 Prior Art
FIG. 4 is a cross-sectional view of a support surface of the prior art.
Figure 2:
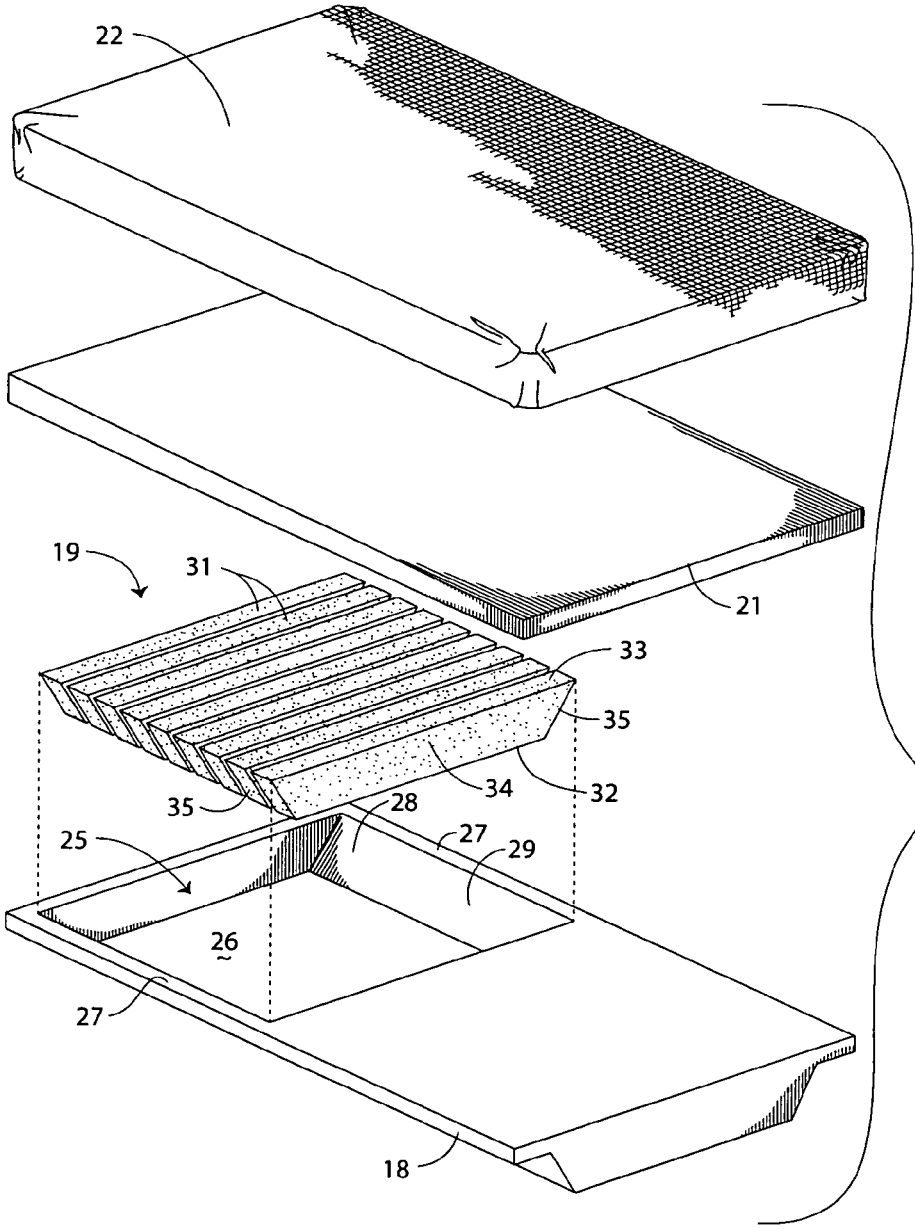
FIG. 2 is an exploded view of the support surface of FIG. 1.

In use, the trapezoidal configuration of the air cells 31 nests closely within the confines of the perimeter well 25. The angular orientation of the cell end walls 35 conform to the angular orientation of the deck side walls 15. This configuration of the end walls 35 allows the air cells 31 to extend nearly to the periphery of the support surface 10. This is very different from the prior art support surfaces, shown in FIG. 4, which included a large perimeter area or bolster between the air cells 31 and the periphery of the support surface due to the generally vertical orientation of the air cell side walls. Hence, the multiple trapezoidal-shaped air cells which form the truncated-triangular shaped core 19 of the present invention provides a greater amount of patient supporting surface area defined by the air cells 31.

It should be understood that the core 19 may not extend along the entire longitudinal length of the support surface 10, for example, the foot section of the support surface may be comprised of a foam material, a plurality of different air cells, or other conventionally known materials.

It should also be understood that the walls of the air cells and perimeter are not rigid and therefore the geometric terms used herein are intended to identify general shapes or generalized geometric appearance of objects. Hence, the geometric terms are not intended to be strictly defined in absolute terms, such as perfectly straight walls, surfaces and the like, due to inherent bowing of some materials and the rounding of corners. Similarly, the geometric terms are intended to represent three dimensional shapes in addition to two dimensional shapes, for example, the term trapezoidal also is intended to include an object's thickness rather than simply being planar.

It should also be understood that the number of air cells or the size of each air cell may differ without departure from the teachings herein. Furthermore, each air cell may be comprised of several smaller cells, for example one trapezoidal shaped cell may be formed by a rectangular air cell straddled by two triangular shaped air cells.

Although it has been shown and described in its preferred form, it should be understood that other modifications, additions or deletions may be made thereto without departure from the spirit and scope of the invention as set forth in the following claims.

The invention claimed is:

1. A patient support surface comprising:

a plurality of patient support air cells, each said air cell being oriented laterally and having a generally trapezoidal shape along its lateral length defined by two oppositely disposed ends walls diverging from each other as they extend upwardly;

a resilient perimeter surrounding said air cells, said perimeter includes an interior well defined by a floor and at least two oppositely disposed side walls with interior facing surfaces adjacent said air cells diverging from each other as they extend upwardly from said floor and with exterior facing surfaces oriented generally parallel with said interior facing surfaces; and a foam topper overlaying said air cells.

2. The patient support surface of claim 1 further comprising a surrounding cover.

3. A patient support surface comprising:

a resilient perimeter bolster having an interior well defined by a floor and at least two side walls having interior facing surfaces diverging from each other as they extend upwardly from said floor and having exterior facing surfaces opposite said interior facing surfaces, said exterior facing surfaces diverging from each other as they extend upwardly;

at least one patient support air cell positioned within said interior well, said at least one air cell having a bottom wall, a top wall, two oppositely disposed side walls extending between said bottom wall and said top wall, and two oppositely disposed end walls extending between said bottom wall and said top wall, said end walls diverging from each other as they extend from said bottom wall to said top wall; and a topper overlaying said at least one air cell.

4. The patient support surface of claim 3 further comprising a cover at least partially overlaying said perimeter and said topper.

5. The patient support surface of claim 3 wherein said at least one air cell is oriented laterally across said perimeter bolster.

* * * * *